United States Patent [19]

Robinson

[11] 3,988,051

[45] Oct. 26, 1976

[54] CLAMPING MEANS FOR CLASPING TERMINAL POSTS

[76] Inventor: Charles T. Robinson, 604 Barbara Road, Landing, N.J. 07850

[22] Filed: Aug. 18, 1975

[21] Appl. No.: 605,519

[52] U.S. Cl. ..... 339/238; 339/266 G

[51] Int. Cl.[2] ..... H01R 11/00

[58] Field of Search ..... 339/224–240, 339/255 P, 266; 269/228, 131

[56] References Cited

UNITED STATES PATENTS

| | | | |
|---|---|---|---|
| 3,641,473 | 2/1972 | Attaway | 339/255 P X |
| 3,840,843 | 10/1974 | Izraeli | 339/255 P X |

*Primary Examiner*—Roy Lake
*Assistant Examiner*—E. F. Desmond
*Attorney, Agent, or Firm*—Thomas N. Neiman

[57] ABSTRACT

Essentially, the clamping means comprise the basic, operative structure of the known lever-wrench pliers, a common type thereof which is sold under the trade mark "Vise Grip". According to the invention, however, an electrical conductor is mechanically and conductively coupled to the fixed head of one of the handles of the pliers. Too, the heads of the working handles of the pliers have been adapted to envelop and compressively clasp a terminal post of a storage battery, or a grounding rod, and the like. In a first embodiment of the invention, the heads have arcuate jaws formed therein compressively to enclose a terminal post. In another embodiment, the heads carry portions of the electrical conductor and cause a loop of the conductor to clamp about the terminal post, or whatever.

7 Claims, 8 Drawing Figures

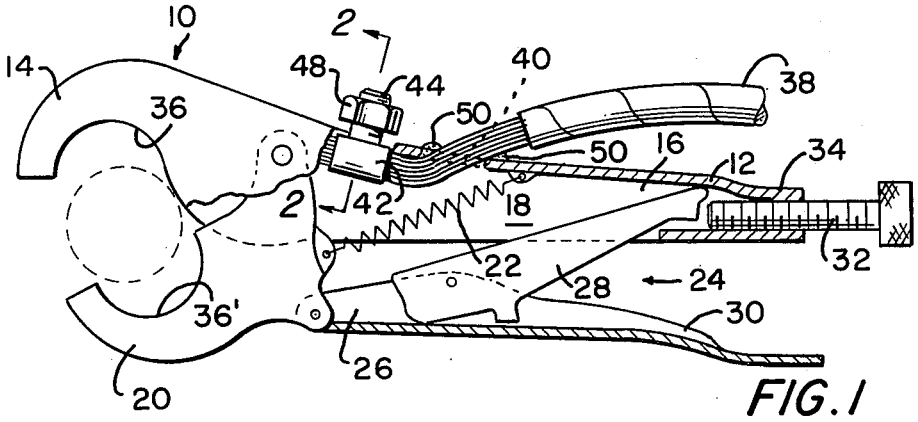
FIG. 1
FIG. 2
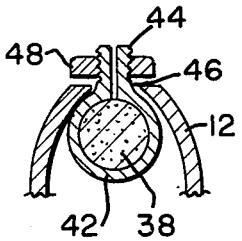
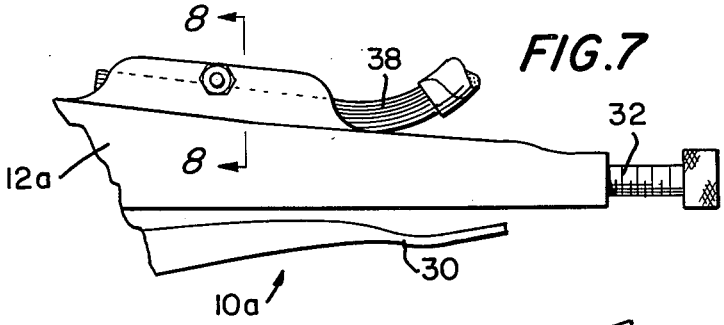
FIG. 7
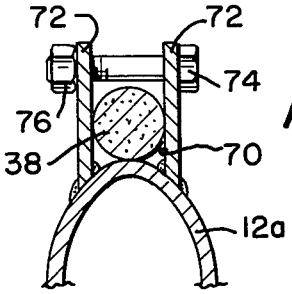
FIG. 8
FIG. 6
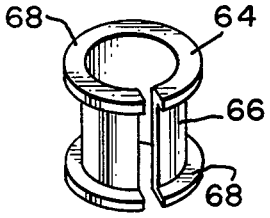
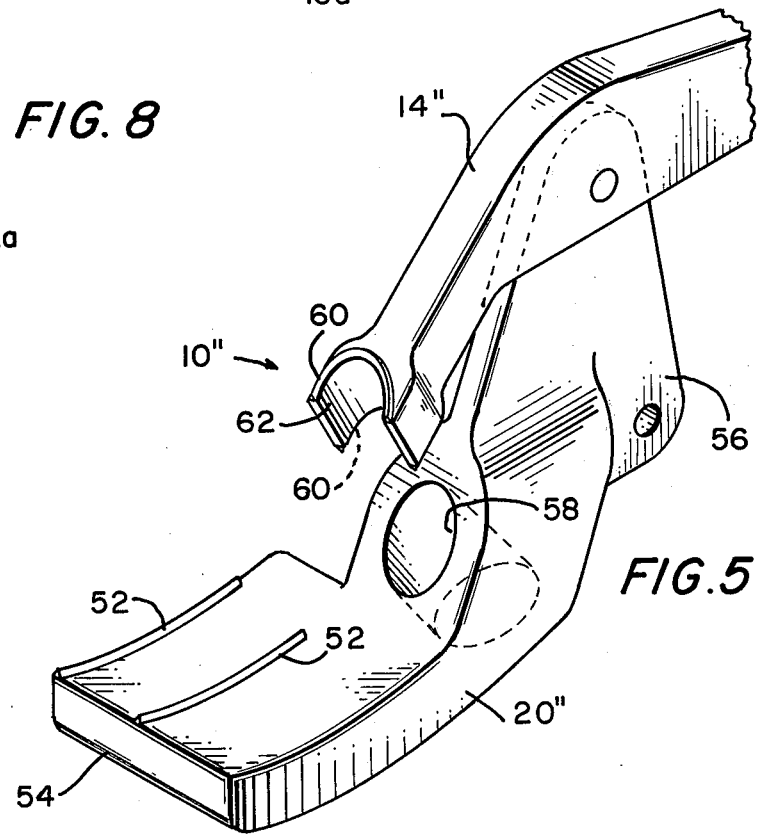
FIG. 5

CLAMPING MEANS FOR CLASPING TERMINAL POSTS

This invention pertains to clamping means for clasping a terminal post of a storage battery, or a grounding rod, and the like, and in particular to such clamping means which carry or accommodate an electrical conductor as well.

Clamping means of the type noted, in the prior art, have been small devices comprising movable jaws, or the like, which are closed upon a terminal post, or whatever, by means of a bolt and nut, or equivalents. Notwithstanding the fact that such known devices effect good electrical contact and conductivity, they are difficult to secure about a terminal post, and what is more they are even more difficult to remove.

In the use of the prior art types of terminal post clamping means, it is customarily necessary to use a wrench or pliers or both to fasten and remove the same. With recurring fastenings and removals of the clamping means, the latter soon becomes scored, "chewed-up", and generally lose both shape and efficiency. Too, the fastening hardware undergoes the same abuse. What has long been needed is a clamping means which efficiently makes a good electrical contact, which is simple to remove and fasten, and which is readily and facilely adjustable as to its clasping ability.

It is an object of this invention, then, to set forth a clamping means for clasping terminal posts, or the like, which satisfies the aforementioned long felt need.

Particularly is it an object of this invention to disclose clamping means, for clasping a terminal post or a storage battery, or a grounding rod, and the like, comprising an elongate element, having a first head on one end thereof and at least one channel on the end opposite said one end; a second head pivotally mounted to said first head; further including a toggle arrangement including a plurality of pivotally connected sections; one end of one of said sections being pivotally connected with said pivotally mounted head, the free end of another of said sections being nested in said one channel for movement thereof lengthwise of said one channel; a fulcrum carried by said elongate element with which said free end of said another section engages, to delimit the lengthwise movement of the latter; lever means extending from one of said sections for activating said toggle arrangement, to cause said pivotally mounted head to pivot, and to cause said another section to pivot upon said fulcrum, to move said heads into and out of proximity with each other — toward and away from a terminal post, grounding rod, and the like; said lever means and said toggle arrangement being cooperative to lock said heads in close proximity; an electrical conductor; and means effecting a coupling of said conductor to, and electrical continuity thereof with, at least one of said heads or handles.

Further objects of this invention, as well as the several features thereof, will become more apparent by reference to the following description taken in conjunction with the accompanying figures, in which:

FIG. 1 is a side, elevational view, the handle and lever being shown partly in cross-section, of a first embodiment of the invention;

FIG. 2 is a cross-section taken along section 2—2 of FIG. 1;

FIG. 5 is a perspective view of the heads of the FIG. 4 embodiment;

FIG. 6 is a perspective view of an annulus of conductive material usable with the inventive embodiments of FIGS. 1 and 3;

FIG. 7 is a side, elevational view, in a scale reduced from those of FIGS. 1, 3 and 4, of still another embodiment of the novel clamping means; and FIG. 8 is a cross-sectional view, taken along section 8—8 of FIG. 7, this view being enlarged over the scale of FIG. 7.

Figure 3:
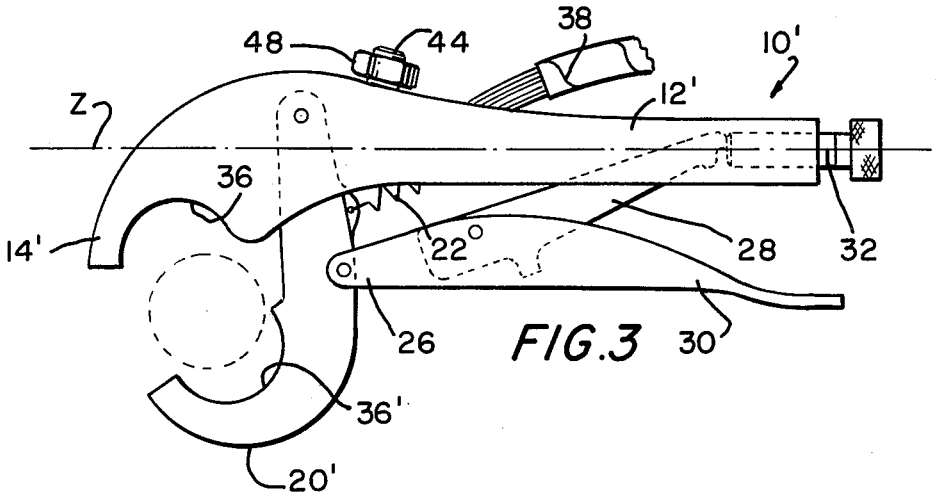
FIG. 3 is a side, elevational view of an alternative embodiment of the invention.

As shown in FIGS. 1 and 2, a first embodiment of my novel clamping means 10 comprises the basic, cooperative components of the known lever-wrench pliers, the same including an elongate handle 12 having a stationary head 14 on one end thereof and a channel 16 formed in the opposite end. The channel 16 is defined by spaced apart, terminal side walls 18 — one of which being shown, the other thereof having been cut away to disclose the inner structure of the means 10.

A second, movable head 20 is pivotally coupled to the stationary head 14, and is biased, by means of spring 22, into a position remote from head 14. A toggle arrangement 24, comprising a pair of sections or limbs 26 and 28 pivotally coupled together, is pivotally coupled to head 20. A free end of section 28 is slidably engaged with the channel 16, and a lever 30 projects from section 26. The free end of section 28 engages the innermost end of a fulcrum-defining adjustment bolt 32; bolt 32 is threadedly engaged with the threaded/-neck end 34 of handle 12.

Thus far, clamping means 10 is not different from the known lever-wrench pliers, the same having an operation and functioning as described in U.S. Pat. No. 2,280,005, issued on Apr. 14, 1942, to William Petersen for a "Wrench". Such lever-wrench pliers' operation and functioning being well known to those skilled in this art, it is deemed unnecessary to detail such here. Suffice it to say that the handle 12, toggle arrangement 24, and lever 30 operate in the known way to move the heads 14 and 20 into and out of proximity with each other, and to lock the heads in close proximity — as selectively determined by the setting of bolt 32 relative to neck end 34.

It is a teaching of my invention to modify and improve the classic lever-wrench pliers, by forming arcuate-faced jaws 36 and 36' in the heads 14 and 20, and by mechanically and electrically coupling an electrical conductor to at least one of the heads or handles. In FIGS. 1 and 2, a free end of a conductor 38 is passed through an aperture 40 formed in the crown of the handle 12. This free end is enveloped by a sleeve 42 which carries a split bolt 44. The latter penetrates an aperture 46 and is held fast by means of nut 48. If considered desirable, welding beads 50 may be added whereat the conductor emerges from the aperture 40.

According to my novel teaching, means 10 is especially adapted to clasp a terminal post or grounding rod, with a selective compression — by adjustment of bolt 32 — and it carries the conductor 38 therewith. The simple facility with which means 10 can engage and disengage a terminal post is self-evident; the novel means comprises its own "wrench". There is this too: while not shown, the jaws 36 and 36' can have the customary transverse serrations or ribs (customary in planar-faced jaws). These are useful for semi-rigidly clasping the terminal posts of a storage battery, or the like, and turning up raw metal. It remains only to effect the half clasp, and swing the handle 12 and lever 30 through a small angle, to expose a fresh-contact surface in the terminal post.

FIG. 3 depicts an alternative embodiment of the invention 10' in which the jaws 36 and 36' are offset from the axis "Z" of the handle 12'. Such an embodiment will find utility where it is necessary to displace the operative elements of the clamping means, as much as possible, from the surface of the battery (or whatever), and have the jaws 36 and 36' "reach in" to clasp the terminal posts.

Figure 4:
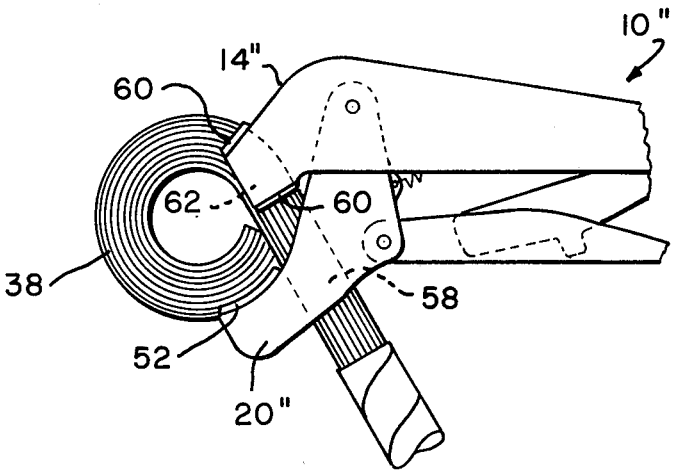
FIG. 4 is a side, elevational view of yet another embodiment of the invention.

FIG. 4 illustrates a major portion of yet another embodiment of the invention 10'' in which the heads 14'' and 20'' carry the conductor 38. A perspective view of the heads of this embodiment are shown in FIG. 5. The movable head 20'' has a terminal end of the conductor 38 secured thereto, by welding beads 52, on an offset base 54. A shank 56 of the head 20'' has a throughgoing aperture 58 formed therein slidably to receive an intermediate portion of the conductor 38. Further, a section of the conductor 38 secured to head 14'' by a pair of welding beads 60 which rim a cove 62 arcuately formed in the terminal end of the head 14'' to nest the conductor. In order that the configuration of the heads 14'' and 20'' might be seen to better advantage, FIG. 5 has the conductor omitted.

The novel embodiment 10'' functions quite the same as the structure disclosed in U.S. Pat. No. 3,192,804, issued to Christian Petersen, et al, July 1965, for "Chain Clamps" — with the novel improvement wherein conductor 38 is carried by the head 14'' and 20'' and compressively clasps a terminal post (or the like), and makes electrical connection therewith.

It is frequently desirable to employ an intermediary element, between the clamping means and the terminal post, an element which itself is inexpensive and, therefor readily expendable, and which thus may be clamped compressively — to the degree that it may become scored, "chewed-up" and otherwise abused. To this end, I further teach the interposition of a split annulus 64 between the jaws 36 and 36' of the FIGS. 1 and 3 embodiments. Annulus 64 has a hollow, cylindrical shank 66 for enveloping a terminal post, and a pair of end flanges 68 for engaging sides of the heads 14 and 20 (and 14' and 20'). When an annulus 64 has been corrupted beyond further efficient use, it is simply discarded and a new annulus 64 is employed. Annulus 64, preferrably, is formed of a compliant or malleable material, such as copper or lead or the like, which further will insure good electrical conductivity therethrough.

FIGS. 7 and 8 illustrate still a further embodiment **10*a* which is much like embodiment 10 (FIG. 1) except that handle 12*a* has a second channel 70 formed therein. The same is defined of a pair of upstanding walls 72 borne on the crown of the handle 12*a*. An end of the conductor 38 is pressed in between the walls 72 and a bolt 74 which penetrates both walls is torqued up by means of a nut 76 — to secure the conductor 38 therein, and to effect good conductivity thereof with both the walls 72 and the crown of the handle 12*a*. Here too, if desired, supplementary welding of the conductor 38 to the handle 12*a* and walls 72** may be practiced.

By taking instruction from my disclosure, others can readily conveive of yet further embodiments of the invention. As, for example, in lieu of an annulus 64, a pair of hemispheric segments may be used with the FIGS. 1 and 3 embodiments. So also, the conductor 38 could just as well be fixed in the movable head 20 (or 20') rather than the stationary head 14 (or 14'); as well, the terminal end of the conductor 38 could be secured to the stationary head 14'' of the FIG. 5 embodiment, simply by providing said head with an offset and apertured base (like base 54) and fastening a section of the conductor 38 to the stationary head 14''. Accordingly, while I have described my invention in connection with specific embodiments thereof, it is to be clearly understood that this is done only by way of example, and not as a limitation to the scope of my invention as set forth in the objects thereof and in the appended claims.

Another embodiment of my invention would comprise the incorporation of yet another type of "Vise Grip" or lever-wrench pliers, notably that set forth in U. S. Pat. No. 2,489,057, granted to Ernest J. St. Laurence, on Nov. 22, 1949, for Lever Operated Gripping Tool with Slidable Jaw Face. In such an embodiment, of course, the patentee's Tool would function as disclosed in his patent, grippingly to clasp a terminal post, grounding rod, and the like, but the same would have my inventive improvement: an electrical conductor, and means effecting a coupling of the conductor to, and electrical continuity thereof with, at least one of the heads or handles of the St. Laurence Tool. Possibly the latter Tool would be better suited to my inventive improvement, as the same teaches a sliding-jaw type of arrangement. Probably a better "seating" could be achieved from this.

Each of the embodiments depicted comprise one fixed head or jaw and one movable jaw or head. It is anticipated that this will prove to be the preferred practice of the invention, and the one more economical of manufacture. My invention, however, is not restricted to this type, neither are my claims limited to such. On the contrary, the invention, and the claims directed thereto, embrace "Vise Grip" or lever-wrench pliers which comprise a plurality of movable jaws or heads.

Further alternative practices of my invention are self-evident from my disclosure. To wit: the Chain Clamps of priorly referenced U.S. Pat. No. 3,192,804, of Petersen et al. is readily adaptable for incorporating my invention, as presented herein (in FIGS. 1 and 2) in connection with the Petersen Wrench of U.S. Pat. No. 2,280,005. That is, the Chain Clamp device is employable with the clamping chain, albeit with an electrical conductor secured to at least one of the jaws or handles. The annulus 64 shown in FIG. 6 comprises a straight shank 66. Certainly the annulus can take other forms — such as a uniformly tapering shank, the latter defining a truncated cone, rendering it usable on battery terminal posts of such configuration.

As a matter of economy, where the novel clamping means are fabricated for use on standard battery terminals, then the degree of opening and optimum closure for the jaws or heads can be readily determined. Thus, such clamping means can dispense with the adjusting bolt 32. In lieu thereof, it will only be necessary to fix a permanent fulcrum element within the handle 12 to receive the sliding end of toggle section 28. Too, economy of manufacture and/or the use to be made of the invention will dictate whether the conductor 38 ought to be replaceable or permanently (and substantially unreplaceably) secured to the head or handle of the lever-wrench pliers. Primarily, my invention will be of benefit to owners of automobiles, trucks, generators, starting motors, and the like, which use storage batteries. Thus, such persons will not often have need to open and close the novel clamping means. Rather, they will — on occasion — open them, perhaps to dress the terminals of the battery, or to replace an annulus 64, or to replace the battery entirely. Following such ministrations, they will simply reclamp the clamping means to the battery terminals, and leave it undisturbed for perhaps a thousand operating hours. In garages and repair shops, however, it is likely that clamping means according to my invention will be frequently and repeatedly handled, opened and closed, dropped, be stepped on, and generally receive hard wear. Now, the only part of the novel clamping means which is subject to early mortality, due to wear and abuse, is the conductor itself. It has more flexibility and compliance than the other components of the device, and yet it can be snapped, or become frayed, and the like. It is for this contingency that I disclose the conductor as replaceable. Thus, my disclosure and claims embrace both types, and I leave it to the public to determine which of the two better serves its purposes. The only limitations to the scope of my invention, then, are those set forth in the objects thereof and in the claims which follow.

I claim:

1. Clamping means, for clasping a terminal post of a storage battery, or a grounding rod, and the like, comprising:

an elongate element, having a first head on one end thereof and at least one channel on the end opposite said one end;

a second head pivotally-mounted to said first head;

a toggle arrangement;

said toggle arrangement including a plurality of pivotally connected sections;

one end of one of said sections being pivotally connected with said pivotally-mounted head, the free end of another of said sections being nested in said one channel for movement thereof lengthwise of said one channel;

a fulcrum carried by said elongate element with which said free end of said another section engages, to delimit the lengthwise movement of the latter;

lever means extending from one of said sections for activating said toggle arrangement, to cause said pivotally-mounted head to pivot, and to cause said another section to pivot upon said fulcrum, to move said heads into and out of proximity with each other toward and away from a terminal post, grounding rod, and the like;

said lever means and said toggle arrangement being cooperative to lock said heads in close proximity;

an electrical conductor; and means effecting a coupling of said conductor to, and in electrical continuity thereof with, at least one of said heads; wherein one of said first and second heads has a base portion and a shank portion;

said base portion has a terminal end of said electrical conductor coupled thereto;

said shank portion has a throughgoing aperture formed therein; and an intermediate portion of said electrical conductor is in penetration of said aperture.

2. Clamping means, according to claim 1, wherein:

said intermediate portion of said electrical conductor is slidably engaged with said aperture for movement of said portion of said conductor therethrough.

3. Clamping means, according to claim 2, wherein:

said first head has a section of said electrical conductor coupled thereto.

4. Clamping means, according to claim 3, wherein:

said section is intermediate said terminal end of said conductor and said intermediate portion thereof.

5. Clamping means, according to claim 1, wherein:

said elongate element has an axis; and said first head terminates at a position offset from said axis.

6. Clamping means, according to claim 1, wherein:

said heads have jaws formed therein for compressively clasping a terminal post, grounding rod, and the like, therebetween.

7. Clamping means, according to claim 6, further including:

means formed of electrically-conductive material, such as lead, copper, and the like, for nesting thereof with said jaws for interpositioning between said jaws and a terminal post, grounding rod, or the like.

* * * * *